US005152016A

United States Patent [19]

Becker

[11] Patent Number: 5,152,016

[45] Date of Patent: Oct. 6, 1992

[54] TRANSFER BOARD

[76] Inventor: Danny L. Becker, Rte. 2, Box 43, Merrill, Iowa 51038

[21] Appl. No.: 532,432

[22] Filed: Jun. 4, 1990

[51] Int. Cl.[5] ..... A61G 7/08

[52] U.S. Cl. ..... 5/81.1; 193/35 R; 5/925

[58] Field of Search ..... 5/81 R, 81 B, 81 C, 5/445; 193/35 R, 37

[56] References Cited

U.S. PATENT DOCUMENTS

| | | | |
|---|---|---|---|
| 1,151,894 | 8/1915 | Meinecke | 5/435 |
| 3,792,500 | 2/1974 | Swara, Sr. | 5/81 B |
| 3,840,102 | 10/1974 | Dawson | 193/35 R |
| 3,962,736 | 6/1976 | Fedfile | 5/431 |
| 4,644,594 | 2/1987 | Johnson | 5/428 |
| 4,932,090 | 6/1990 | Johansson | 5/445 |
| 4,967,427 | 11/1990 | Cherepy, Sr. | 5/81 C |

FOREIGN PATENT DOCUMENTS

| | | | |
|---|---|---|---|
| 1389185 | 4/1975 | United Kingdom | 193/35 |

*Primary Examiner*—Alexander Grosz
*Attorney, Agent, or Firm*—Zarley, McKee, Thomte, Voorhees & Sease

[57] ABSTRACT

A transfer board comprising a flat board member having tapered opposite ends is provided to enable a patient to transfer from a chair to a bed or the like. The board has a plurality of rollers rotatably mounted thereon which support the buttocks of the patient to enable the patient to easily from one end of the board to the other. The board is also provided with a plurality of openings formed in the upper surface of the board into which a handle may be inserted to enable the patient to pull herself from one end of the board to the other.

2 Claims, 3 Drawing Sheets

TRANSFER BOARD

BACKGROUND OF THE INVENTION

This invention relates to a transfer board and more particularly to a transfer board having a plurality of rollers mounted thereon to facilitate the transfer of a patient from a bed to a chair or the like.

Conventional transfer boards consist of a flat rectangular board usually having tapered opposite ends. The transfer board is normally positioned between a bed and the chair or the like to enable a patient to slide across the board to move from the bed to a chair, chair to commode, etc. It is especially difficult for a person to transfer herself between a bed and chair, for example, if the patient is a paraplegic.

One of the disadvantages of the conventional transfer board is that the top surface of the board tends to rip or pinch the patient's buttocks as the patient moves from one end of the board to the other.

It is therefore a principal object of the invention to provide an improved transfer board.

Still another object of the invention is to provide an improved transfer board including a plurality of rollers rotatably mounted thereon which facilitates the movement of the patient from one end of the board to the other.

Still another object of the invention is to provide a transfer board having non-skid surfaces on the lower opposite ends thereof to aid in preventing the board from slipping during use.

Still another object of the invention is to provide a transfer board including means by which the patient may pull herself from one end of the board to the other.

These and other objects will be apparent to those skilled in the art.

SUMMARY OF THE INVENTION

Figure 1:
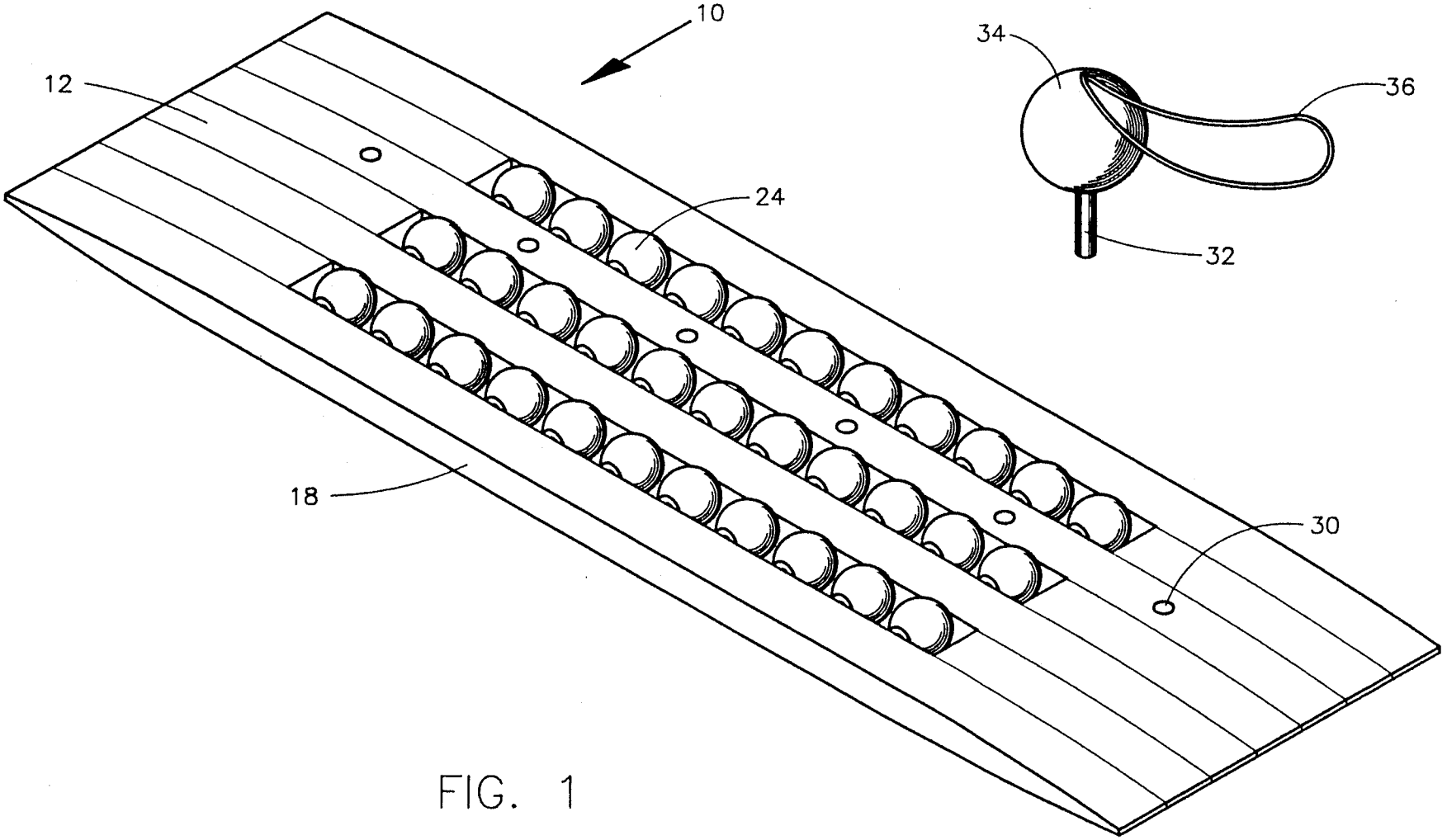
FIG. 1 is a perspective view of the transfer board of this invention.
Figure 2:
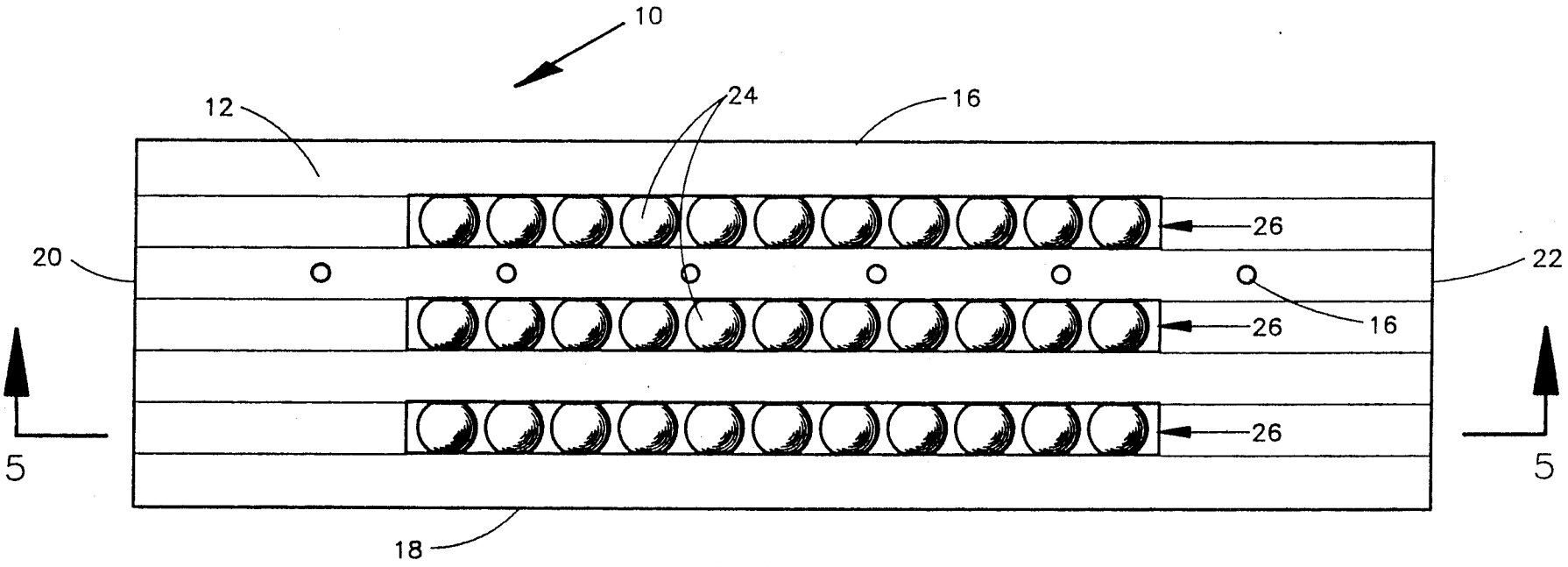
FIG. 2 is a top view of the invention.
Figure 3:
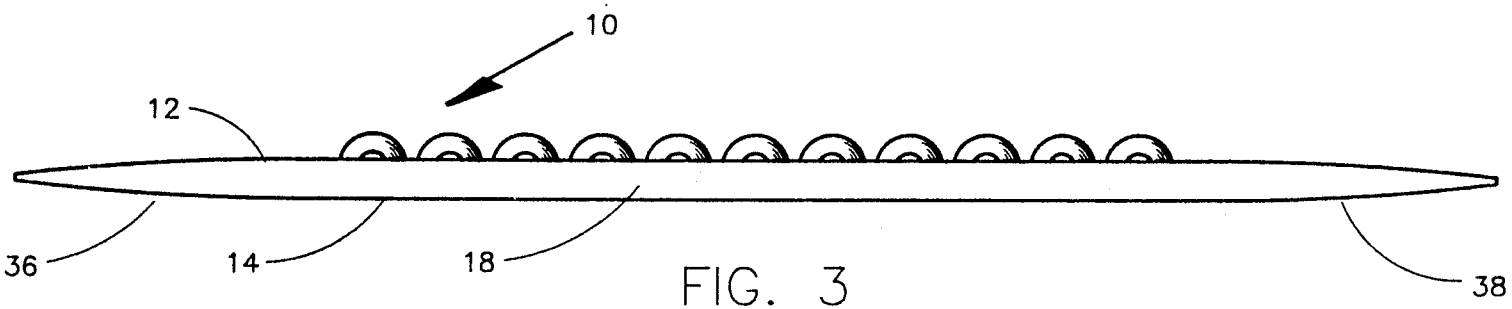
FIG. 3 is a side view of the invention.
Figure 4:
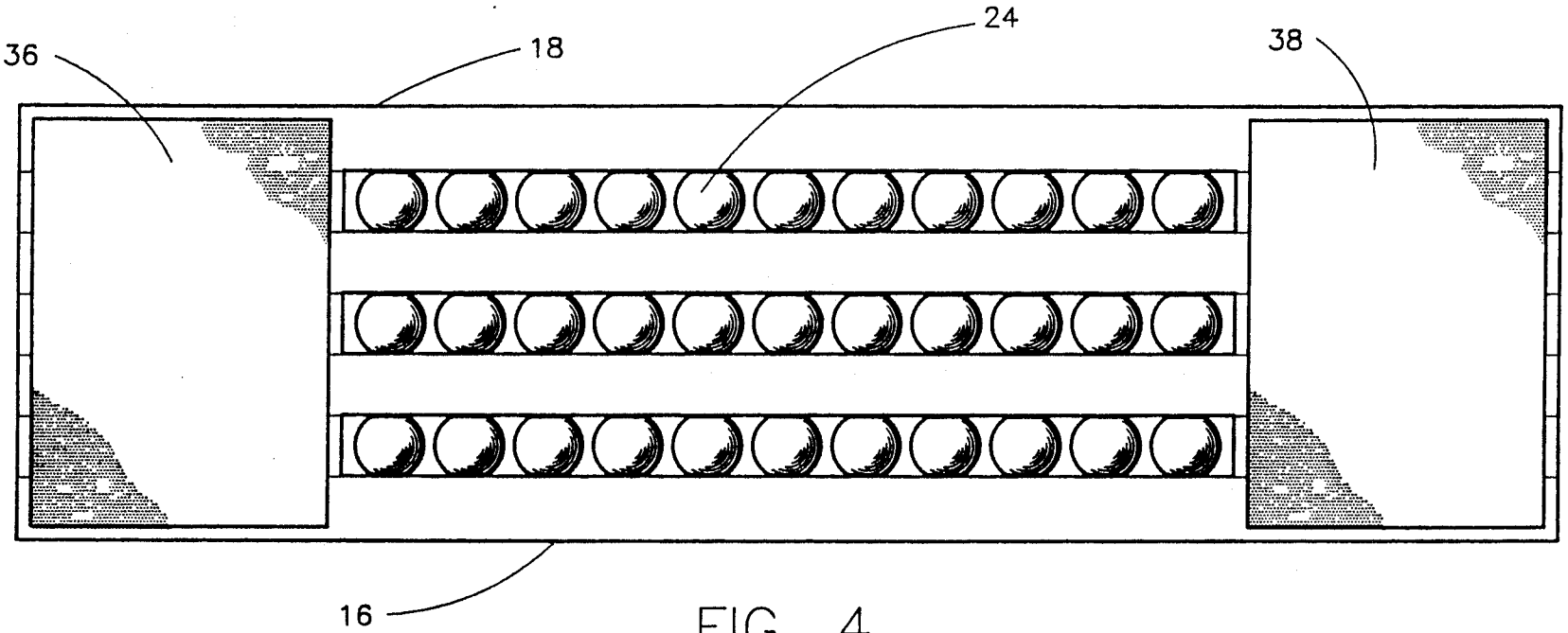
FIG. 4 is a bottom view of the invention.
Figure 5:
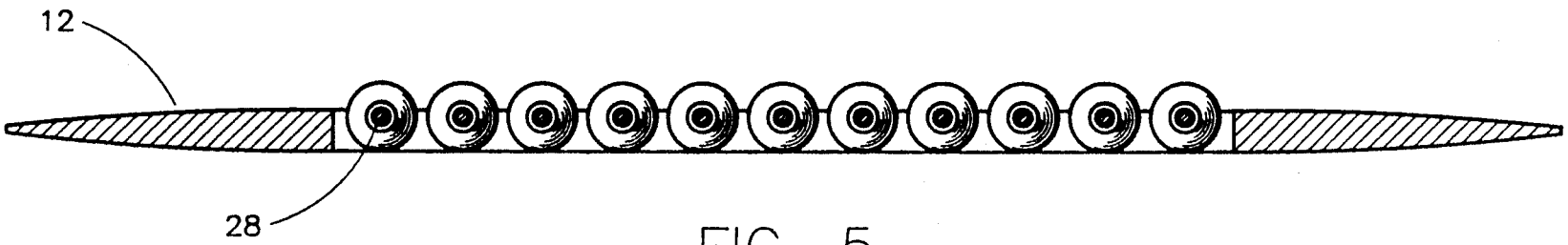
FIG. 5 a sectional view as seen on lines 5—5 of FIG. 2.

The transfer board of this invention comprises a flat board member having a substantially rectangular shape with the opposite ends thereof being tapered to facilitate the patient moving onto and off of the ends of the board. Non-skid surfaces are provided on the underside of the board at the opposite ends thereof to aid in preventing the board from slipping during use. A plurality of rotatably mounted rollers are mounted on the board between the ends thereof to aid in the patient moving across the board. Not only do the rollers prevent the pinching or gripping of the person's buttocks, but they tend to aid in creating circulation in the patient's buttocks. Means is also provided on the board to enable the patient to pull herself from one end of the board to the other.

DESCRIPTION OF THE PREFERRED EMBODIMENT

The transfer board of this invention is referred to generally by the reference numeral 10 and includes a top surface 12, bottom surface 14, opposite side edges 16 and 18, and opposite ends 20 and 22.

A plurality of rollers 24 are rotatably mounted on the board in rows 26 about a horizontal axis which is transverse to the longitudinal axis of the board 10. Any number of rows 26 may be utilized but the same being dependent upon the size and weight of the patient utilizing the board. Preferably, the rollers 26 are mounted on steel axles 28 which extend transversely through the board 10 as seen in the drawings.

A plurality of openings or holes 30 extend downwardly into the board 10 from the upper surface thereof between the ends thereof and which are adapted to receive the shank 32 of handle 34. Preferably, a handle strap 36 is secured to the handle 34 for looping around the patient's hand or wrist.

The board of this invention is used as follows. The opposite ends of the board are su upon the chair or bed and the non-skid surfaces 38 and 36 on the underside of the board 10 aid in preventing the board from slipping during use. The patient will grip the handle 34 and will insert the shank 32 into one of the openings 30 and will then pull herself towards the board through the use of the handle 34. As the patient's buttocks engage the upper surface of the rollers 24, the rollers 24 will aid in transferring the patient from one end of the board to the other. Not only do the rollers 24 prevent gripping or pinching of the person's buttocks, but they also have been found to aid in creating circulation in the patient's buttocks during the transfer operation. It is important to note that the bottoms of the rollers 24 do not protrude below the bottom surface of the board thereby ensuring that they will be able to freely rotate during the transfer operation.

While the board is preferably constructed of wood material, the board could be constructed of any suitable material.

Thus it can be seen that the invention accomplishes at least all of its stated objectives.

I claim:

1. A board for facilitating the transfer of a person between spaced-apart supports, comprising, a substantially flat, rectangular shaped member having first and second ends, an upper surface, a lower surface and opposite side edges, a plurality of rollers mounted on said flat member, between the ends thereof, with the rotational axes thereof disposed transversely to the length of said flat member, said rollers being positioned relative to said flat member to that said rollers have portions thereof positioned above the upper surface of said flat member so that a person supported upon and sliding form one end of said flat member to the other end thereof will at least be partially supported upon said rotatably mounted rollers during the transfer of the person between said ends, said flat member having a plurality of spaced-apart openings extending downwardly into said flat member between the ends thereof for receiving a gripping handle means therein.

2. A board for facilitating the transfer of a person between spaced-apart supports, comprising, a substantially flat, rectangular shaped member having first and second ends, an upper surface, a lower surface and opposite side edges, a plurality of rollers mounted on said flat member, between the ends thereof, with the rotational axes thereof disposed transversely to the length of said flat member, said rollers being positioned relative to said flat member so that said roller have portions thereof positioned above the upper surface of said flat member so that a person supported upon and sliding from one end of said flat member to the other end thereof will at least be partially supported upon said rotatably mounted rollers during the transfer of the person between said ends, said rollers being positioned relative to said flat member so that said rollers do not protrude below said lower surface, said flat member having its opposite ends tapered for facilitating the movement of the person onto said flat member, the lower surface of said flat member being provided with non-skid surfaces adjacent the opposite end-thereof.

* * * * *